US006606452B1

(12) United States Patent
Caine

(10) Patent No.: US 6,606,452 B1
(45) Date of Patent: Aug. 12, 2003

(54) HOT WATER HEATER ANODE

(76) Inventor: Donald R. Caine, 5308 Dorchester Rd., Greensboro, NC (US) 27407

( * ) Notice: Subject to any disclaimer, the term of this patent is extended or adjusted under 35 U.S.C. 154(b) by 0 days.

(21) Appl. No.: 10/158,269

(22) Filed: May 30, 2002

(51) Int. Cl.[7] ..... H05B 3/78
(52) U.S. Cl. ..... 392/457; 392/441; 392/449
(58) Field of Search ..... 392/457, 445, 392/449

(56) References Cited

U.S. PATENT DOCUMENTS 2,568,594 A * 9/1951 Robinson ..... 204/196.11
3,558,463 A * 1/1971 Strobach et al. ..... 204/196.18
4,093,529 A * 6/1978 Strobach ..... 204/196.11
4,224,126 A * 9/1980 Bidwell ..... 204/196.19
4,773,977 A * 9/1988 Houle et al. ..... 204/196.17
5,334,299 A * 8/1994 Roden ..... 204/196.11
5,853,553 A * 12/1998 Twigg ..... 29/825
5,855,747 A * 1/1999 Lusk ..... 204/196.19

* cited by examiner

*Primary Examiner*—Thor Campbell

(57) ABSTRACT

A bi-metallic anode is disclosed for use in small hot water heaters such as in recreational vehicles, motor homes and the like. The anode includes a threaded portion and a shaft formed from a relatively non-corrosible metal such as steel, A second section made from a corrosible metal such as magnesium is affixed to the shaft. In use, the shaft spaces the corrosible section from the inner tank wall and fitting, thus providing for a more effective and longer lasting hot water heater.

5 Claims, 2 Drawing Sheets

HOT WATER HEATER ANODE

FIELD OF THE INVENTION

The invention herein pertains to corrosible anodes for hot water heaters and particularly pertains to a bi-metallic anode for use in a recreational vehicle (RV) water heater.

DESCRIPTION OF THE PRIOR ART AND OBJECTIVES OF THE INVENTION

Recreational vehicles, motor homes, campers and the like utilize small hot water heaters which are gas or electric powered for the convenience of the occupants. Such water heaters are often made having a metal tank which is lined with a polymeric foam or other material to prevent leaking and to prevent metal contact with the contained water. Particularly when heated, water can be highly corrosive to certain materials and over time can cause a water tank to leak and cause damage, requiring expensive repairs or replacement. To prevent such leaks a sacrificial anode is generally placed in the water tank which will corrode more readily than the metal tank. Anodes in the past have been usually fabricated from metals such as aluminum or magnesium and have steel threads for connecting to the tank fitting. Most manufacturers recommend that such anodes be checked periodically, several times a year to ensure that the anode is still effective and has not totally deteriorated.

Problems have developed in the past, particularly with steel/magnesium bi-metallic anodes in that the corrosive activity of the anode is too near the inner tank wall, whereby the inner tank wall and fitting begins corroding, even while the distal end of the anode which projects into the tank water remains unaffected.

Thus, with the problems and disadvantages of conventional corrosible anodes in hot water heaters, the present invention was conceived and one of its objectives is to provide a corrosible water heater anode which will better protect the inner tank surface and fitting.

It is still another objective of the present invention to provide a corrosible anode which includes a cylindrical shaft of steel which spaces the more corrosible magnesium or other metal a safe distance from the inner tank surface.

It is yet another objective of the present invention to provide a bimetallic anode having a steel, threaded first section and a magnesium second section.

It is still another objective of the present invention to provide an anode for a hot water heater which can be easily positioned in a conventional anode fitting.

Various other objectives and advantages of the present invention will become apparent to those skilled in the art as a more detailed description is set forth below.

SUMMARY OF THE INVENTION

The invention herein pertains to anodes as are used in hot water heaters, particularly small hot water heaters as are found in RVs. Anodes formed of corrosible material such as aluminum, magnesium and the like are commonly used in the industry. However, the use of conventional anodes has caused RV owners problems in that the tanks begin to leak, often near or at the fitting which retains the anode. Conventional bi-metallic anodes are made of a relatively non-corrosive metal such as steel and a highly corrosible metal such as aluminum, magnesium or the like. As the magnesium and steel sections of an anode are usually joined at or very close to the tank fitting, the corrosive activity often causes the fitting and tank inner surface to likewise corrode. Thus, during periodic checks of the anode, for example, on a two or three month basis, the anode may be difficult to remove from the fitting since the threads of the fitting and anode deteriorate. In addition, after a prolonged period the hot water within the tank penetrates the inner tank protective coating and corrodes the metal inner tank surface near the fitting.

The present invention is designed to extend the corrosible section of the anode further into the tank, away from the tank inner surface and fitting, thus distancing the sphere of corrosive activity from the fitting and inner tank surface. The bi-metallic anode described herein includes a first section formed of steel and has a head, threads and a shaft. The second or corrosible anode section of the preferred anode is cylindrically shaped. The second anode section is affixed to the steel shaft, thus the steel shaft spaces or distances the second anode section from the steel threads of the first section and the fitting in the tank wall. The steel shaft thus distances the corrosible section and corrosion activity a safe distance from the tank inner surface.

DETAILED DESCRIPTION OF THE PREFERRED EMBODIMENT AND OPERATION OF THE INVENTION

Figure 1:
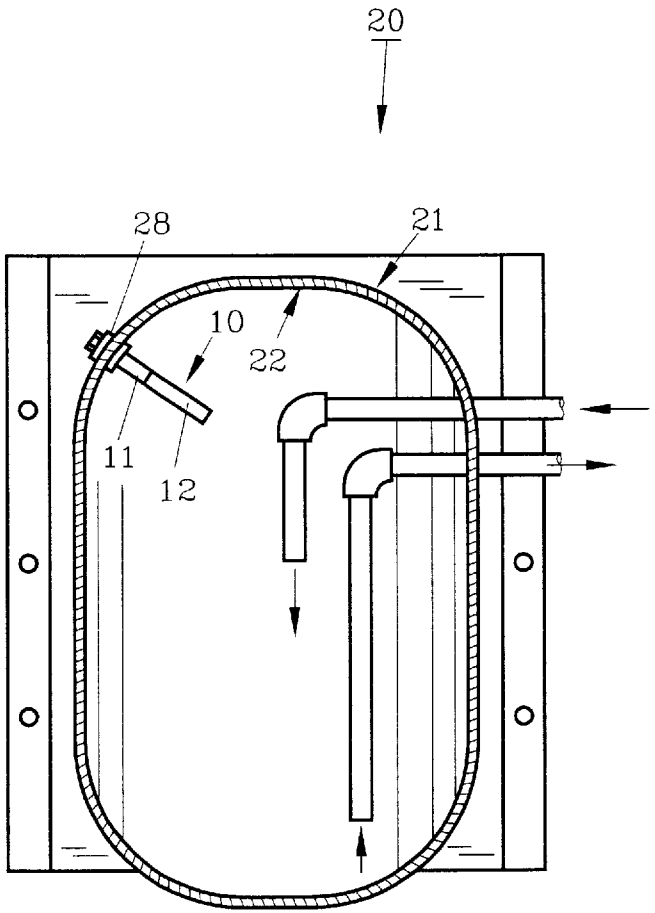
FIG. 1 demonstrates a cross-sectional schematic view of a typical RV hot water heater.

For a better understanding of the invention and its operation, turning now to the drawings, FIG. 1 demonstrates a typical RV gas fired hot water heater 20 with tank 21 (seen in cross-sectional view) which may have a capacity of six to eight gallons of water as sold by various manufacturers including Atwood Mobile Products, Inc. of Rockford, Ill. Tank 21 is formed from aluminum and has a conventional interior thin polymeric foam coating 22 (generally along the entire interior metal tank surfaces) to help protect the interior metal tank surfaces from corrosion and rupture. Standard controls and gas burning elements are not shown in FIG. 1 for simplicity and clarity. Mounted within tank 21 is preferred anode 10 as shown in more detail enlarged in FIG. 2. Preferred anode 10 includes first section 11 formed from steel and having head 13 with shoulders 14 for gripping. Threads 19 allow anode 10 to attach within threaded fitting 28 in tank 21 as shown in FIG. 1. First section 11 also includes cylindrical shaft 15 (FIG. 3) which is smooth and unthreaded and separates second section 12 from threads 19. Shaft 15 preferably has a diameter of 0.66" (1.67 cm) and a length of 0.875" (2.2 cm). By way of contrast, FIG. 5 demonstrates prior art anode 30 with first steel section 31 and second magnesium section 32 directly attached to threads 33. Thus, cylindrical shaft 15 of anode first section 11 separates second section 12 also having a diameter of 1.67 cm, from the interior surface of tank 21 approximately 2.2 cm when installed in tank 21 and prevents anode corrosion proximate the inner surface of tank 21 by spacing second section 12 therefrom.

Figures 2, 3, 4:
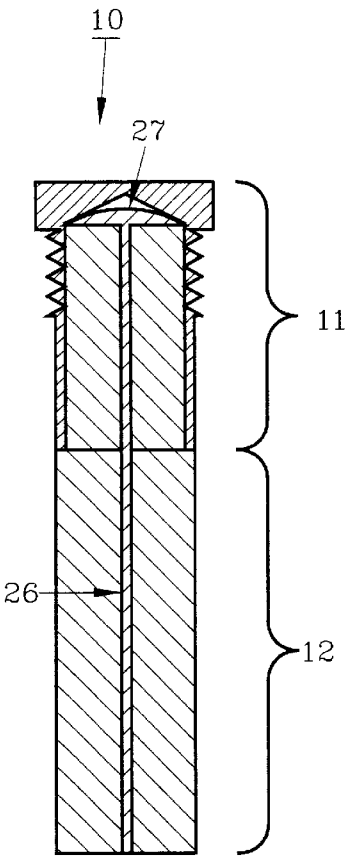
FIG. 2 illustrates the preferred form of the corrosible anode of the invention.
FIG. 3 features the anode as shown in FIG. 2 in cross-sectional view with the sections separated.
FIG. 4 depicts a cross-sectional view of the embodiment as shown in FIG. 3 in an assembled view.

As further seen in FIG. 3, first anode section 11 includes internal channel 16 for receiving neck 17 of second section 12. Neck 17 has a smaller diameter than body 18 of second section 12. Cylindrical body 18 has the same diameter as cylindrical shaft 15 of first section 11 as seen in FIG. 2. As further seen in the assembled cross-sectional view of anode 10 in FIG. 4, second section 12 is formed substantially of magnesium which is readily corrosible and is sacrificed to prevent corrosion along the inside surface of tank 21 below coating 22. Second section 12 is formed of a corrosible metal, preferably magnesium, and includes steel inner core 26 with steel cap 27 as is conventional.

Figure 5:
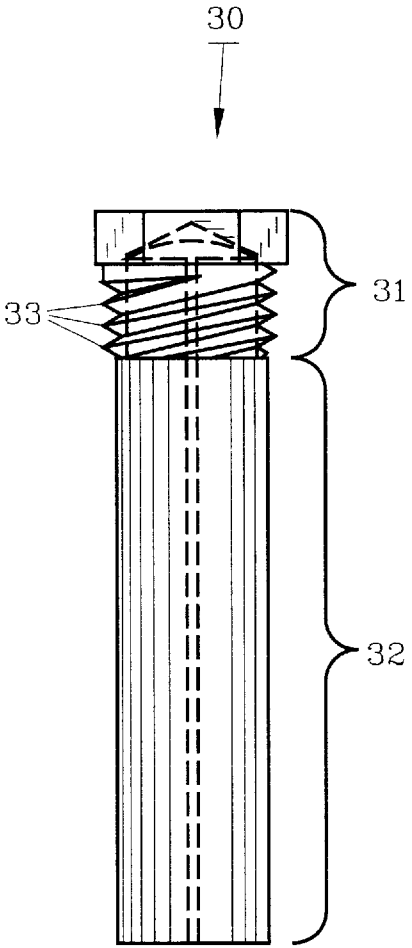
(PRIOR ART) FIG. 5
FIG. 5 shows a typical bi-metallic prior art anode.

In use, a standard hot water heater such as hot water heater 20 as shown in FIG. 1 is turned off and a conventional anode such as anode 30 seen in FIG. 5 is threadably removed manually from fitting 28 with a wrench or other tool. Next, anode 10 is threaded into tank fitting 28 whereby second section 12, formed of corrosible magnesium is positioned inwardly of and spaced from the inner tank surfaces as shown in FIG. 1. As hot water having corrosive properties is contained within tank 21, anode 10 will corrode along second section 12, safely separated from fitting 28 and the metal inner tank surfaces. Anode 10 can be checked periodically and easily replaced in fitting 28 as needed.

The illustrations and examples provided herein are for explanatory purposes and are not intended to limit the scope of the appended claims.

I claim:

1. An anode for a water heater comprising: a first relatively non-corrosible section, said first section defining a head, a aeries of external threads and a shaft, said head and said shaft affixed to said external threads on opposite ends, said external threads and said shaft defining a continuous internal channel, a second corrosible section, said second section defining a neck and a body, said neck having a smaller diameter than said body, said neck contained within said continuous channel of said external threads and shaft with the body of said second section abutting the shaft whereby said shaft separates said body from said external threads.

2. The anode of claim 1 wherein said first section is formed of steel.

3. The anode of claim 1 wherein said second section comprises magnesium.

4. The anode of claim 1 wherein the diameter of said shaft and said second section are the same.

5. The anode of claim 1 wherein said head defines a plurality of shoulders.

* * * * *